United States Patent [19]

Irwin et al.

[11] 4,394,046

[45] Jul. 19, 1983

[54] CONVERTIBLE ROCKER AND HIGH CHAIR

[76] Inventors: Warren W. Irwin; Greg W. Irwin, both of 1330 Bluegrass Rd., Vista, Calif. 92083

[21] Appl. No.: 277,628

[22] Filed: Jun. 26, 1981

[51] Int. Cl.[3] ..... A47C 3/02

[52] U.S. Cl. ..... 297/132; 297/270; 297/345

[58] Field of Search ..... 297/130, 131, 132, 338, 297/345, 258, 270, 118

[56] References Cited

U.S. PATENT DOCUMENTS

| | | | |
|---|---|---|---|
| 387,586 | 8/1888 | French | 297/345 X |
| 408,612 | 8/1889 | Gifford et al. . | |
| 559,424 | 5/1896 | Weiland et al. | 297/132 X |
| 604,941 | 1/1898 | Paine . | |
| 677,382 | 7/1901 | Thompson . | |
| 677,383 | 7/1901 | Thompson . | |
| 682,961 | 9/1901 | Smith . | |
| 736,180 | 8/1903 | Washburn | 297/345 X |
| 775,387 | 11/1904 | Thompson . | |
| 2,494,045 | 1/1950 | Kauffman | 297/131 |
| 3,269,771 | 8/1966 | Erdos | 297/132 |
| 4,278,288 | 7/1981 | Thebaud | 297/118 |

FOREIGN PATENT DOCUMENTS

| | | | |
|---|---|---|---|
| 1014044 | 5/1952 | France | 297/131 |

*Primary Examiner*—James T. McCall
*Attorney, Agent, or Firm*—Brown & Martin

[57] ABSTRACT

A convertible chair for children supported by two pairs of curved pivotally connected and extendable cross legs that serve as rockers when the chair is in its lowered or nested position. Two pairs of pivotally connected and extendable cross arms are attached at one end to the ends of the cross legs, and at their other ends make pivotal connections to a skirt below the chair seat. Separation of the cross arms and cross legs permits converting the rocking chair to a high chair having stable support on the ends of the extended cross legs. The pairs of cross legs, cross arms, and chair skirt are pivotally joined together by transverse rungs. Cam apertures in the forward sections of the chair skirt, and a control rung which passes through the apertures, control the chair extension, and in conjunction with locking pawls on the interior surface of the chair skirts permit locking the chair in its position as a rocker or high chair. The orientation of the cam apertures establishes a rearward tilt to the chair in either operating position.

6 Claims, 4 Drawing Figures

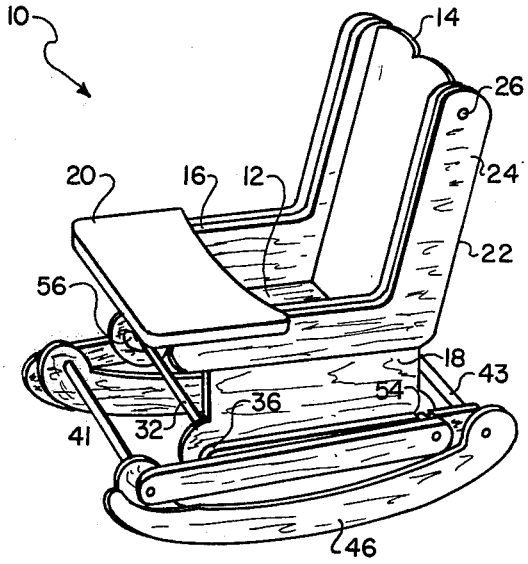
FIG. 1
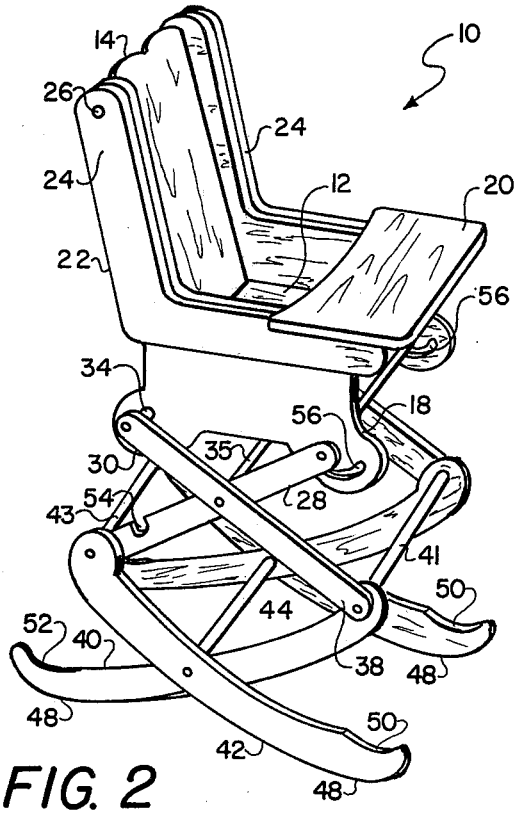
FIG. 2
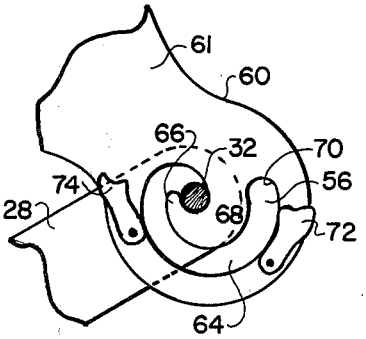
FIG. 4
FIG. 3
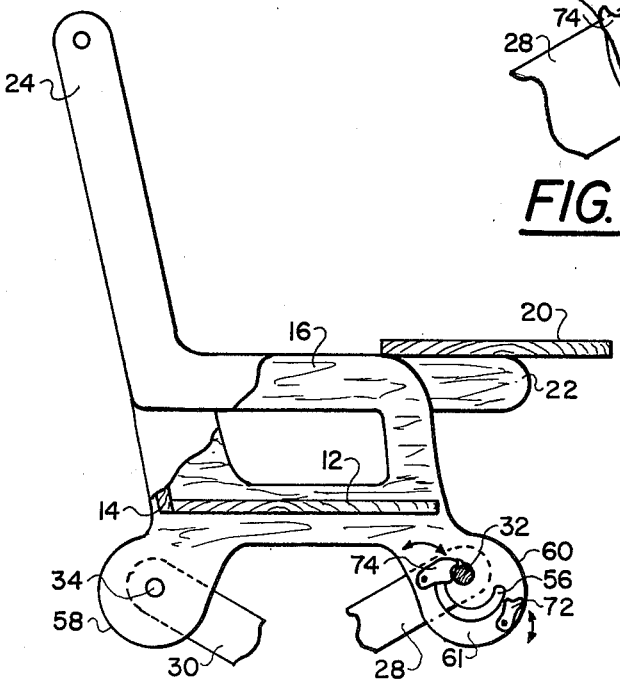

CONVERTIBLE ROCKER AND HIGH CHAIR

BACKGROUND OF THE INVENTION

Chairs suitable for the use by children have a continuing attraction and utility. If such a chair has the appearance and function of an adult chair, such as a rocker, it not only provides a place for the child to rest, but has added advantage of permitting movement and emulating adults. A child's high chair is of great convenience in feeding the child, and in providing a place for supervised activity without the necessity of stooping, or the need for providing a child's seat within an adult chair.

A convertible child's rocker and high chair gives the advantages of both of the former configurations, and is particularly useful if it also is an attractive piece of furniture that is compact and easily handled in use and transport.

There have been convertible rockers before, but their designs are less versatile and compact, and they are awkward in appearance. In the usual case, the rocker element pairs were separable to form legs to raise and support the seat of the chair that was rigidly connected to ends of the rockers. This arrangement limited the extension of the chair in height, and did not permit pivotal movement of the chair to allow a backward tilt to the chair seat to assist in keeping a child from sliding from the seat. Various locking arrangements have been employed in previous designs to maintain the convertible chair in its extended position. These locking arrangements usually consisted of separate latches or bar stops that were additional components for use after the chair had been raised, rather than being an integral part of a more versatile convertible chair design.

It is desirable, therefore, to provide an attractive convertible rocker and high chair capable of double extension from a lowered, or fully nested position, and having an easily operated and unobtrusive integrated control and locking design. It is also desirable to have a locking mechanism that not only secures the chair in either the up or down position, but also permits additional security for the chair occupant by providing a rearward tilt to the seat.

SUMMARY OF THE INVENTION

The invention relates to a chair that may be used as a rocking chair or converted to a child's high chair. The chair has a rigid seat with depending skirts at its sides, a back, and arms. Two pairs of centrally pivoted and adjacent inner and outer cross arms are pivotally mounted to the chair skirt at their upper ends by transverse rungs. The opposite ends of the cross arm pairs are pivotally connected by transverse rungs to the upper ends of two pairs of inner and outer centrally pivoted adjacent cross legs. The cross legs are curved on their under sides to serve as rockers for the chair when it is in its lowered condition. The pivotal tandem connection of the cross arm and cross leg pairs permits a double extension of the chair above its lowered position when the inner and outer cross arms and cross legs are separated, and at the same time provide stable support upon the ends of the open cross legs when the chair is fully raised to the high chair position.

Two cam apertures are located in the forward part of the chair skirts. A transverse control rung connecting the upper ends of the inner cross arms passes through these apertures and is guided and supported by the internal surfaces of the apertures when the configuration of the chair assembly is changed. Rotating pawls located on the inner surfaces of the skirts are used to engage and lock the control rung against the cam surface to secure the assembly in its rocker or high chair configuration.

The primary object of the invention is to provide a new and improved convertible rocker and high chair that is both useful and decorative. The chair components nest fully together in the lowered position to provide a rocker with minimum height above ground level and with a compact and attractive appearance. Providing a rearward tilt to the seat contributes to the safety of its occupant during use. An easily operated positive control and locking mechanism is an integral part of the chair positioned in a protective location to prevent its inadvertant operation. A removable serving tray may be rotatably mounted to the back of the chair for providing both an eating and playing surface. These together with other advantages will become apparent in considering the detals of construction and operation of the convertible rocker and high chair as they are more fully described. Reference will be made to the accompanying drawings wherein like numerals refer to like parts throughout and in which:

FIG. 1 is a perspective view of the convertible chair assembly in its lowered or rocker configuration.

FIG. 2 is a perspective view of the convertible chair assembly in its raised or high chair configuration.

FIG. 3 is a sectional view of the inside left face of the chair as shown in FIG. 2, partially cut away to illustrate the control and locking mechanism.

FIG. 4 is a view of the control and locking mechanism of FIG. 3 shown in greater detail.

DETAILED DESCRIPTION OF THE DRAWING

The configuration of the convertible chair assembly 10 is illustrated in FIG. 1 in its rocker configuration, and as a high chair in FIG. 2. In the embodiment illustrated the components of chair assembly 10 are made of wood. This construction contributes to the attractiveness of chair assembly 10 as a piece of furniture. For the purpose of the following description, the terms front and forward refer to the direction faced by an occupant of the chair.

As illustrated in FIG. 1, the chair has a rigid seat 12, a back 14, arms 16, and a rigid skirt 18. Skirt 18 extends below seat 12 on either side of seat 12. The chair is also provided with a service tray 20, that is supported by L-shaped members 22, that combine with the tray 20 to enclose the chair seat area as shown. The upper ends 24 of support members 22 are pivotally connected to the back 14 of the chair by dowels 26, so that the tray 20 may be removed or rotated out of the way to permit ready access to the chair seat 12.

As illustrated in FIG. 2, the chair skirt 18 is pivotally mounted to two pairs of inner cross arms 28 and outer cross arms 30, one pair of which is on either side of chair assembly 10. The inner cross arms 28 fit between the outer cross arms 30, and are centrally pivoted thereto by transverse rungs 35 so that when closed together, as in FIG. 1, the pair of cross arms are parallel. As illustrated in FIGS. 1 and 2, the upper ends of the inner and outer cross arms 28 and 30 are connected to the chair skirt 18 by transverse rungs 32 and 34, rung 32 being further denominated as the control rung in the description that follows. The opposite or lower ends 36 and 38 of the inner and outer cross arms are pivotally connected to two pair of inner cross legs 40 and outer cross legs 42 by transverse rungs 41 and 43. The inner cross legs 40 are fitted between the outer cross legs 42, and are centrally pivoted thereto by transverse rung 44 so that when closed together as illustrated in FIG. 1, the pairs of cross legs are parallel. The inner and outer cross legs 40 and 42 are longitudinally convex, or curved on their under sides 46 (FIG. 1) to form rockers for the chair when they are brought together.

The tandem pivotal connection of the cross arms and cross legs provide an extendable mechanism for raising and lowering the chair assembly 10 from the nested or rocker position, as illustrated in FIG. 2. When the chair is raised, the pairs of cross legs are separated and their free ends 48 become stable supports for the high chair. To allow maximum nesting of the convertible chair components in their rocker configuration and thus provide a more compact and attractive chair, the upper surfaces 50 of outer cross legs 42 are cut away, or relieved, so as to receive the ends 38 of the outer cross arms when the chair is lowered. Similarly, the upper surfaces 52 adjacent to the rearward ends of the inner cross legs 40 are relieved to receive the lower ends of the inner cross arms 28. Additionally, the inner cross arms 28 are provided with a notch 54 to receive transverse rungs 34 (FIG. 2) when chair assembly 10 is lowered.

The mechanism for controlling and locking the chair assembly 10 in its alternate configuration is performed by cam apertures 56 that are illustrated in all figures, but are more particularly visible in FIGS. 3 and 4. Chair skirts 18 have rear sections 58 and front sections 60. The skirt rear section 58 pivots about cross rung 34 which connects the rear section 58 of the skirt to the ends of the outer cross arms 30. This feature allows both the double extension of the chair, and in combination with the control and locking mechanism to be described, permits the chair assembly 10 to be inclined to the rear in both the rocker and high chair position. Cam apertures 56 are located in the forward skirt sections 60. Control rung 32 passes through the cam apertures 56. Apertures 56 consist of semi-circular slot portion 64 and a rearwardly facing lobe 66 which combine to form internal cam surfaces. When the chair assembly 10 is in its upper position, control rung 32 is secured in the cusps 68 of lobes 66 as illustrated in FIGS. 3 and 4. In the rocker position, control rung 32 is secured at the forward end 70 of slot 64. Pawls 72 and 74 are pivotally connected on the inside faces 61 of the skirts 18, and are used for locking control rung 32 in its rocker and high chair positions, respectively.

Apertures 56 are cut in skirt sections 60 with a selected rotational orientation of lobes 66 to provide a desired rearward tilt of the seat 12 in both the rocker and high chair configurations to assist in preventing the chair occupant from sliding from seat 12. Since rear skirt sections 58 pivot about rung 34, raising or lowering the locked position of control rung 32 with respect to the height of rung 34 will establish an inclination of seat 12. For example, if apertures 56 are rotated toward the front of the chair assembly 10 when they are cut, cusps 66 will be raised with the result that when locked in the cusps 66, control rung 32 will raise the front section 60 of skirt 18 with respect to the rear section 58 when in the high chair position. Such a rotation of apertures 56 will similarly raise the front section in the rocker position since the end 70 of channel section 64 will be lower with respect to rung 34 when the chair is in the rocker configuration.

OPERATION

To convert chair assembly 10 from its locked rocking chair configuration as shown in FIG. 1, pawl 72 is rotated away from engagement with control rung 32. The chair is then raised by grasping its back 14. As the chair is raised, control rung 32 travels along the semi-circular slot 62 of aperture 56 until it can be placed in cusp 68 of lobe 66. To lock the chair assembly 10 in its high chair position, pawl 74 is then rotated into engagement with rung 32 to prevent its removal from cusp 68. To lower and lock chair assembly 10 in its rocker configuration, the above procedure is reversed.

Having described our invention, we now claim:

1. A convertible rocker and high chair comprising:

a chair having a back, arms, and a rigid seat, a skirt depending from the sides of the seat and having a front section and a rear section, two pairs of inner and outer centrally pivoted cross arms pivotally mountable at their upper ends to the chair skirt, two pairs of inner and outer centrally pivoted cross legs curved on their under sides to form rockers when the chair is lowered, the cross legs being pivotally mounted at their upper ends to the lower ends of the cross arms to form a doubly extendable mechanism for raising and lowering the chair, transverse rungs connecting opposite pairs of cross legs and cross arms at their pivot points, the front section of the skirt having a cam aperture with internal cam surfaces, a control rung connecting the upper ends of the inner cross arms and passing through the cam aperture for controlling the extension of the chair, means for securing the control rung within the cam aperture to lock said chair in its upper or lower configuration.

2. A convertible rocker and high chair as recited in claim 1, wherein:

the outer cross legs having faired cut away sections on their upper surfaces adjacent to their forward ends to receive the ends of the outer cross arms when the chair is lowered, the inner cross legs having a faired cut away section on their upper surfaces adjacent their after ends to receive the ends of the inner cross arms when the chair is lowered, and the inner cross arms having notches in their upper surfaces to receive the rung connecting the upper ends of the outer cross arms to the chair skirt when the chair is lowered.

3. A convertible rocker and high chair as recited in claim 2, wherein:

the cam aperture has an internal semi-circular shaped channel in its lower half, and a rearwardly oriented lobe forming its upper internal surface, and a cusp on the upper surface of the lobe to receive and support the control rung when said chair is in its high chair configuration.

4. A convertible rocker and high chair as recited in claim 3, wherein the means for locking the control rung in the cam aperture comprises:

a first pivotable pawl spaced adjacent to the cam aperture to engage and hold the control rung in the lobe cusp for the upper positioning of the chair; and a second pivotable pawl spaced adjacent to the cam aperture to engage and hold the control rung at the forward end of the channel in the lowered position of the chair.

5. A convertible rocker and high chair as recited in claim 4, wherein:

the rotational orientation of the cam aperture establishes the tilt of the chair seat in both its upper and lowered positions.

6. A convertible rocker and high chair as recited in claim 5, wherein:

the chair, cross arms, cross legs, rungs, and pawls are made of wood.

* * * * *